US006239557B1

(12) United States Patent
Chang et al.

(10) Patent No.: US 6,239,557 B1
(45) Date of Patent: May 29, 2001

(54) TRANSFORMER WINDING TECHNIQUE WITH REDUCED PARASITIC CAPACITANCE EFFECTS

(75) Inventors: Chin Chang, Yorktown Heights, NY (US); Roderick T. Himman, Natick, MA (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/524,969

(22) Filed: Mar. 14, 2000

(51) Int. Cl.[7] ..... H05B 41/16

(52) U.S. Cl. ..... 315/278; 315/282; 315/209 R; 315/224; 336/180; 336/225

(58) Field of Search ..... 315/278, 282, 315/283, 209 R, 209 PZ, 224, 291; 336/180, 198, 225, 213, 222; 363/17, 24, 56, 68, 133

(56) References Cited

U.S. PATENT DOCUMENTS 4,274,136 * 6/1981 Onodera et al. ..... 363/68
4,449,111 * 5/1984 Nakajima ..... 336/206
4,514,712 4/1985 Mc Dougal ..... 366/96
5,418,513 5/1995 Fujisawa et al. ..... 336/178
5,495,405 2/1996 Fujimura et al. ..... 363/133
5,615,091 * 3/1997 Palatnik ..... 363/17
5,959,412 * 9/1999 Ushijima ..... 315/276

* cited by examiner

*Primary Examiner*—Haissa Philogene

(57) ABSTRACT

A method of winding a step-up transformer substantially minimizes the parasitic capacitance effects between the primary coil of the transformer and the secondary coil of the transformer. The primary coil is wound around a sectional bobbin and laid upon the bobbin in a winding direction that is opposite to the winding direction of the secondary coil. The opposite winding directions allow the high-voltage terminal ends of the primary and secondary coils to be maximally separated. The maximal separation of high-voltage signals within each coil reduces the effects of the capacitive coupling between the coils, and also maximizes the breakdown voltage between the coils. In a preferred embodiment, the auxiliary coil of the step-up transformer is also configured to minimize the effects of capacitive coupling and to maximize the breakdown voltage among the coils.

10 Claims, 2 Drawing Sheets

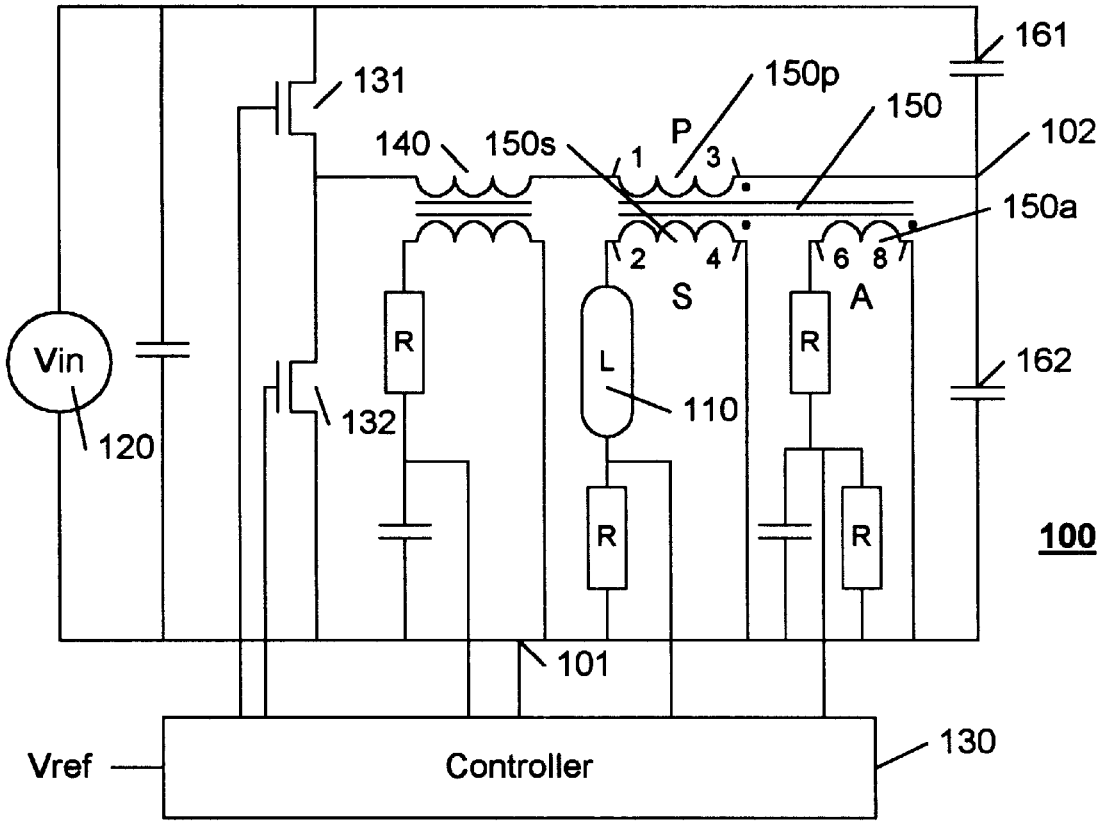
FIG. 1 [Prior Art]
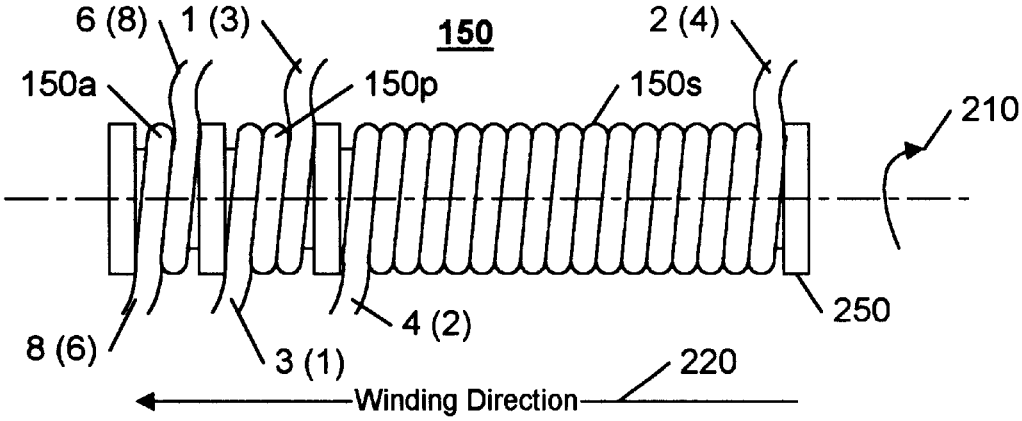
FIG. 2 [Prior Art]

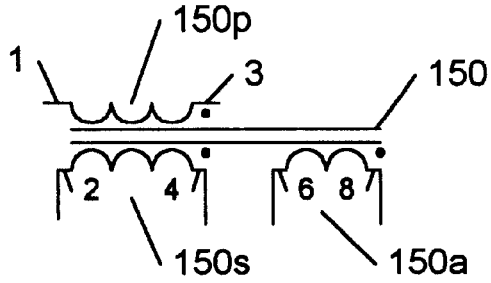
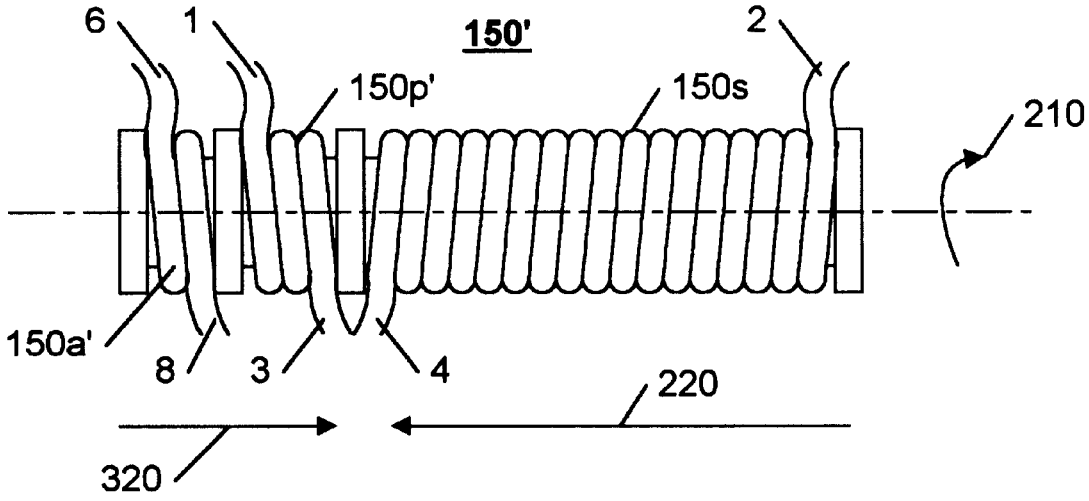
FIG. 3
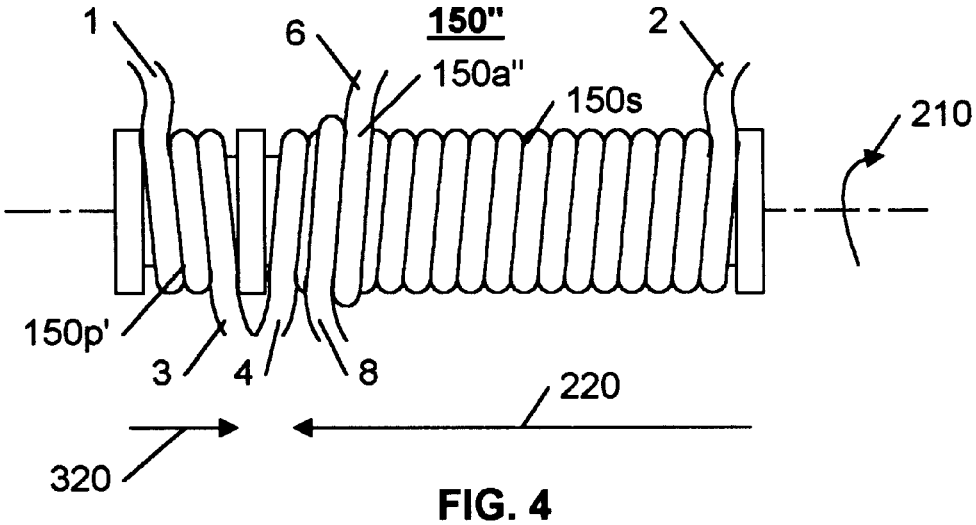
FIG. 4

TRANSFORMER WINDING TECHNIQUE WITH REDUCED PARASITIC CAPACITANCE EFFECTS

BACKGROUND OF THE INVENTION

1. Field of the Invention

This invention relates to the field of transformers, and in particular to transformers used to provide high voltage for lamps.

2. Description of Related Art

FIG. 1 illustrates an example circuit diagram for an electronic ballast 100, as might be used to provide a high-voltage, high-frequency signal for a cold cathode fluorescent lamp 110 from a relatively low-voltage DC supply signal Vin 120. The controller 130 and switching devices 131, 132 control the current flow through the transformers 140, 150, so as to provide the required current to the lamp 110 during the different stages (ignition, steady state, etc.) of the lamp's illumination.

The high-voltage transformation is provided by the step-up transformer 150, which typically has a high turns ratio, such as 300:1, between the secondary 150*s* and primary 150*p* coils. The required high-frequency signal is provided by an LC resonant tank, wherein the transformer 140 form the resonant inductor, and the resonant capacitance is formed by shielding parasitic capacitances and the inter-winding capacitance of transformer 150. U.S. Pat. No. 5,495,405, "Inverter Circuit for Use with Discharge Tube", issued Feb. 27, 1996 for Fujimura et al, teaches the use of the parasitic capacitance produced in the secondary side of the step up transformer as a component of the resonant circuit, and is incorporated by reference herein.

FIG. 2 illustrates an example embodiment of the step-up transformer 150, as typically employed in a prior art electronic ballast 100. Each of the coils 150*s*, 150*p*, and 150*a* are wound by rotating a hollow core bobbin 250 in a direction 210, while a wire is wound around the bobbin 250 and laid upon sections of the bobbin 250 in the illustrated winding direction 220. The wires may be wrapped around a common segmented bobbin, or wrapped around individual bobbin segments that are subsequently bonded together to form the segmented bobbin. After the appropriate number of turns of wire are laid upon the bobbin 250, the wire ends of each coil 150*s*, 150*p*, and 150*a* are made available for connection to the other components of the electronic ballast 100 of FIG. 1. In order to maintain the appropriate coil phases indicated by the "dot" phase convention of each coil 150*s*, 150*p*, 150*a* of FIG. 1, the ends of each coil are arranged as discussed below and as indicated by the two alternative node assignments of FIG. 2. If the starting (right) end of the secondary coil 150*s* is assigned to node 2 (and therefore the terminating (left) end of the secondary coil 150*s* is assigned to node 4), then node 1 must be assigned to the starting (right) end of the primary coil 150*p* and node 3 to the terminating (left) end, in order for the primary 150*p* and secondary 150*s* coils to have the dot-phase relationship indicated in FIG. 1. In like manner, based on the choice of node 2 as the starting end of the secondary coil 150*s*, node 6 must be assigned to the start (right) end of the auxiliary coil 150*a*, and node 8 to the terminating (left) end, in order to maintain the proper phase relationship between the auxiliary coil 150*a* and the secondary coil 150*s*. Alternatively, as indicated by the parenthesized node assignments, if node 4 is assigned to the start (right) end of the secondary coil 150*s*, then node 3 must be assigned to the start (right) end of the primary coil 150*p*, and node 8 must be assigned to the start (right) end of the auxiliary coil 150*a*. As would be evident to one of ordinary skill in the art, the bobbin rotation direction 210 may be reversed, and the winding direction 220 may be reversed.

Coils 150*a*, 150*p*, and 150*s* are inductively coupled by their proximity and relationship to each other. The inductive coupling may be increased by providing a ferrite core within the center of the bobbin 250 that traverses the length of the transformer 150. Unfortunately, the proximity and relationship of coils 150*p* and 150*s* also introduces a capacitive coupling between these coils 150*p* and 150*s*. This capacitive coupling adversely affects the circuit operation of the electronic ballast 100, and severely limits the voltage gain of the step-up transformer 150.

BRIEF SUMMARY OF THE INVENTION

It is an object of this invention to provide a ballast having a high efficiency. It is a further object of this invention to provide a high efficiency high-gain transformer suitable for use in an electronic ballast. It is a further object of this invention to provide a method of winding a transformer that increases the transformer's efficiency.

These objects and others are achieved by providing a method of winding a step-up transformer that substantially minimizes the parasitic capacitance effects between the primary coil of the transformer and the secondary coil of the transformer. The primary coil is wound around a sectional bobbin and laid upon the bobbin in a winding direction that is opposite to the winding direction of the secondary coil. The opposite winding directions allow the high-voltage terminal ends of the primary and secondary coils to be maximally separated. The maximal separation of high-voltage signals within each coil reduces the effects of the capacitive coupling between the coils, and also maximizes the breakdown voltage between the coils. In a preferred embodiment, the auxiliary coil of the step-up transformer is also configured to minimize the effects of capacitive coupling and to maximize the breakdown voltage among the coils.

BRIEF DESCRIPTION OF THE DRAWINGS

The invention is explained in further detail, and by way of example, with reference to the accompanying drawings wherein:

FIG. 1 illustrates an example block diagram of a lamp assembly that includes a step-up transformer that provides a high-voltage high-frequency signal to a lamp.

FIG. 2 illustrates an example winding pattern of a prior art step-up transformer.

FIG. 3 illustrates an example winding pattern of a step-up transformer in accordance with this invention.

FIG. 4 illustrates an alternative example winding pattern of a step-up transformer in accordance with this invention.

Throughout the drawings, the same reference numerals indicate similar or corresponding features or functions.

DETAILED DESCRIPTION OF THE INVENTION

As discussed above, the capacitive coupling between the primary coil of a transformer and the secondary coil of the transformer reduces the efficiency of the transformer, and limits the voltage gain that can be achieved by the transformer.

Each of the coils 150*s*, 150*p*, 150*a* of the transformer 150 have two terminal ends. The terminals 3, 4, and 8 of coils 150*p*, 150*s*, and 150*a* are connected to lower AC voltage sources than their counterpart terminals 1, 2, and 6. That is, nodes 4 and 8 of the secondary 150*s* and auxiliary 150*a* coils are connected to the DC common voltage node 101, commonly termed a ground potential. The voltage at node 2 of the secondary coil 150*s* provides the high-frequency high-voltage signal to the lamp 110, relative to the ground potential 101. Similarly, the voltage at node 6 provides a larger magnitude AC voltage signal than the substantially constant voltage at node 8 of the auxiliary coil 150*a*. Capacitors 161, 162 form a voltage divider that is coupled to the DC input source Vin 120, and provide a substantially constant voltage 102 to node 3 of the primary coil. The controller 130 and switching devices 131, 132 alternately switches the current flowing through the primary coil 150*p*, and induces an AC voltage across the primary coil whose magnitude increases in proportion to the distance from the substantially constant voltage 102 at node 3. For ease of reference, the nodes 3, 4, and 8 are referred to hereinafter as "low-voltage" terminals, and their counterpart nodes 1, 2, and 6 are referred to hereinafter as "high-voltage" terminals.

This invention is based on the observation that the adverse effects caused by capacitive coupling between the primary and secondary coils is dependent upon the magnitude of the AC voltage that is coupled via the capacitive coupling.

Consider the winding configuration of FIG. 2, and the two alternative node configurations, discussed above. As shown by the unparenthesized node numbers, if the secondary high-voltage node 2 is connected to the start (right) end of the transformer 150, the secondary low-voltage node 4 is adjacent the primary coil 150*p*. This is a preferred configuration for the secondary coil 150*s*, because it places the lowest magnitude AC signals in the secondary coil 150*s* closest to the primary coil 150*p* and the highest magnitude AC signals farthest from the primary coil 150*p*. However, this configuration of node assignments to the secondary coil 150*s* forces the primary high-voltage terminal 1 of the primary coil 150*p* to be closest to the secondary coil 150*s*, and the primary low-voltage terminal 3 to be farthest from the secondary coil 150*s*. This is the non-preferred configuration of the primary coil, because it places the higher magnitude AC signals of the primary coil 150*p* closest to the secondary coil 150*s*, and induces more adverse effects from the primary coil 150*p* than the alternative node assignment shown parenthetically in FIG. 2. The alternative node assignment places the primary low-voltage terminal 3 of the primary coil 150*p* closest to the secondary coil 150*s*, and the primary high-voltage terminal 1 farthest from the secondary coil 150*s*, thereby minimizing the adverse effects from the primary coil 150*p*. The alternative node assignment, however, corresponds to the secondary low-voltage node 4 being assigned to the start (right) end of the transformer 150, and the secondary high-voltage node 2 being adjacent the primary coil 150*p*. This is the non-preferred node configuration of the secondary coil 150*s*, because it induces more adverse effects from the secondary coil 150*s* than the above discussed preferred node configuration. That is, either node assignment of the transformer 150 in FIG. 2 results in a non-optimal configuration. Alternative node assignments to the transformer 150 of FIG. 2 will not conform to the dot-phase configuration of FIG. 1.

FIG. 3 illustrates an example winding pattern of a step-up transformer 150' in accordance with this invention. For ease of reference, the circuit diagram of the step-up transformer 150 of FIG. 1 is illustrated. The transformer 150' of FIG. 3 is intended to be a direct replacement for a conventional transformer 150 in an electronic ballast 100 of FIG. 1. As illustrated, the transformer 150' is fabricated by laying the primary coil 150*p*' and secondary coils 150*s* in opposite directions 220, 320. By reversing the winding direction of the primary coil 150*p*' relative to the secondary coil 150*s*, the phase of the winding 150*p*' is reversed, allowing for the preferred nodal assignment to the primary 150*p*' and secondary 150*s* coils shown in FIG. 3. As illustrated, the primary low-voltage terminal 3 and the secondary low-voltage terminal 4 are adjacent, and the primary high-voltage terminal 1 is farthest from the secondary coil 150*s*, and the secondary high-voltage terminal 2 is farthest from the primary coil 150*p*'. This corresponds to the preferred configurations of each of the primary 150*p*' and secondary 150*s* coils, as discussed above, and results in minimal adverse effects caused by the parasitic capacitance coupling of the coils.

The auxiliary coil 150*a*' in FIG. 3 is also oriented so as to reduce the adverse effects caused by the parasitic capacitance coupling of the auxiliary coil 150*a*' with the secondary coil 150*s*. As illustrated, the auxiliary high-voltage terminal 6 is farther away from the secondary coil 150*s* than the auxiliary low-voltage terminal 8 is from the secondary coil 150*s*.

FIG. 4 illustrates an alternative example winding pattern of a step-up transformer in accordance with this invention. In this embodiment, an auxiliary coil 150*a*" is illustrated as being placed coincident with the secondary coil 150*s*. In the example of FIG. 4, the auxiliary coil 150*a*" is illustrated as being placed atop the secondary coil 150*s*, although it could be placed beneath the secondary coil 150*s*, intermixed with the secondary coil 150*s*, and so on. The embodiment of FIG. 4 places the auxiliary high-voltage terminal 6 closer to the secondary coil 150*s* than the embodiment of FIG. 3, but generally the voltage in the auxiliary coil 150*a*" is minimal. The auxiliary coil 150*a*" is used to provide feedback to the controller 130 of FIG. 1 to control the current in the primary coil 150*p*' based on the current flow to the lamp 110 from the secondary coil 150*s*. By concocting the auxiliary coil 150*a*" with the secondary coil 150*s*, fewer turns are required in the auxiliary coil 150*a*", and the fewer turns produce less parasitic capacitance. The relatively low voltage across the auxilary coil 150*a*", combined with the reduced parasitic capacitance, generally favors the embodiment of FIG. 4 over the embodiment of FIG. 3.

The foregoing merely illustrates the principles of the invention. It will thus be appreciated that those skilled in the art will be able to devise various arrangements which, although not explicitly described or shown herein, embody the principles of the invention and are thus within its spirit and scope. For example, the auxiliary coil 150*a*' can also be configured to be coincident with the primary coil 150*p*', either above, beneath, or intermixed with the primary coil 150*p*' in the same segment of the transformer 150. Also, the various arrangements of the transformer 150 in FIGS. 3 and 4 show a partition between the segments of the transformer 150 used to contain each coil 150*a*, 150*s*, 150*p*. These partitions are optional, and can be removed to increase the inductive coupling among coils, to conserve space, and so on. In like manner, the example embodiments of this invention have been presented in the context of a linear arrangement of coils, whereas the principles of this invention are applicable to arbitrary arrangements of coils of any size or shape. In general, the effects of parasitic capacitance can be reduced by arranging the windings of the coil such that the higher AC voltage windings of the coil are farther from other coils than the lower AC voltage windings. These and other system configuration and optimization features will be evident to one of ordinary skill in the art in view of this disclosure, and are included within the scope of the following claims.

We claim:

1. A method of winding a transformer comprising:

rotating a sectional bobbin about a lateral axis, the sectional bobbin including a first section that is laterally adjacent to a second section, winding a primary coil upon the first section of the sectional bobbin in a first winding direction, winding a secondary coil upon the second section of the sectional bobbin in a second winding direction that is opposite to the first winding direction, and winding an auxiliary coil in the first winding direction upon at least one of:

the first section, and a third section of the sectional bobbin that is adjacent the first section and separate from the second section.

2. A method of winding coils for a transformer comprising:

determining a dot-phase relationship between a first coil of the transformer and a second coil of the transformer, assigning each of two terminals of the first coil of the transformer to each of two nodes in a circuit, determining which of the two nodes in the circuit will have a higher AC voltage potential, and which of the two nodes in the circuit will have a lower AC voltage potential, and, orienting the first coil of the transformer such that the terminal that is assigned to the node having the higher AC voltage potential is farther from the second coil of the transformer than the node having the lower AC voltage potential is from the second coil of the transformer, while still maintaining the dot-phase relationship with the second coil of the transformer.

3. The method of claim 2, wherein maintaining the dot-phase relationship with the second coil of the transformer includes:

assigning each of two terminals of the second coil of the transformer to each of two other nodes in a circuit, determining which of the two other nodes in the circuit will have a higher AC voltage potential, and which of the two other nodes in the circuit will have a lower AC voltage potential, determining an orientation of the second coil of the transformer such that the terminal that is assigned to the other node having the higher AC voltage potential is farther from the first coil of the transformer than the other node having the lower AC voltage potential is from the second coil of the transformer, winding the second coil of the transformer in a winding direction that maintains the dot-phase relationship between the first coil of the transformer and the second coil of the transformer orienting the second coil of the transformer in the determined orientation.

4. A transformer comprising:

a first section having a primary coil that is laid upon the first section in a first winding direction, [and]

a second section, adjacent the first section, having a secondary coil that is laid upon the second section in a second winding direction that is opposite to the first winding direction, and an auxiliary coil that is laid upon the second section in the second winding direction.

5. A ballast comprising:

an inverter circuit that is configured to provide a high voltage signal to a lamp, the inverter circuit comprising a step-up transformer comprising:

a primary coil that is laid upon a first section of the step-up transformer in a first winding direction, wherein the primary coil includes:

a primary low-voltage terminal that is coupled to a first voltage source, and a primary high-voltage terminal, the primary low-voltage terminal and primary high-voltage terminal being at opposite extremes of the first section of the step-up transformer, and the step-up transformer further comprises a secondary coil, adjacent the primary coil and inductively coupled to the primary coil, that is laid upon a second section of the step-up transformer in a second winding direction and is configured to provide the high voltage signal to the lamp, wherein the secondary coil includes:

a secondary low-voltage terminal that is coupled to a second voltage source, and a secondary high-voltage terminal that is coupled to the lamp, the secondary low-voltage terminal and secondary high-voltage terminal being at opposite extremes of the second section, the first voltage source and the second voltage source being substantially constant, and the primary low-voltage terminal and the secondary low-voltage terminal are configured to be adjacent each other, so that the primary high-voltage terminal and the secondary high-voltage terminal are maximally separated from each other.

6. The ballast of claim 5, wherein the step-up transformer further comprises an auxiliary coil, inductively coupled to the secondary coil, that provides a feedback signal that facilitates a control of current through the primary coil to regulate the high voltage signal that is provided to the lamp.

7. The ballast of claim 6, wherein the auxiliary coil is laid in the first winding direction upon at least one of:

the first section of the step-up transformer, and a third section of the step-up transformer that is adjacent the first section and separate from the second section.

8. The ballast of claim 6, wherein the auxiliary coil is laid in the second winding direction upon the second section.

9. The ballast of claim 5, wherein the step-up transformer further comprises an auxiliary coil, inductively coupled to the secondary coil, that provides a feedback signal that facilitates a control of current through the primary coil to regulate the high voltage signal that is provided to the lamp, wherein the auxiliary coil includes:

an auxiliary low-voltage terminal that is coupled to a substantially constant voltage source, and an auxiliary high-voltage terminal, the auxiliary low-voltage terminal and auxiliary high-voltage terminal being at opposite extremes of the auxiliary coil, and the auxiliary high-voltage terminal is configured to be farther from the secondary low-voltage terminal than the auxiliary low-voltage terminal is from the secondary low-voltage terminal.

10. A transformer comprising:

a first section having a primary coil that is laid upon the first section in a first winding direction, a second section, adjacent the first section, having a secondary coil that is laid upon the second section in a second winding direction that is opposite to the first winding direction, and an auxiliary coil that is laid upon the first section in the first winding direction.

* * * * *